US011771168B2

(12) United States Patent
Huh et al.

(10) Patent No.: US 11,771,168 B2
(45) Date of Patent: Oct. 3, 2023

(54) HEAD BAND

(71) Applicant: OTOS WING.CO., LTD., Seoul (KR)

(72) Inventors: Moon Young Huh, Seoul (KR); Sung Won Huh, Seoul (KR)

(73) Assignee: OTOS WING.CO., LTD., Seoul (KR)

( * ) Notice: Subject to any disclaimer, the term of this patent is extended or adjusted under 35 U.S.C. 154(b) by 217 days.

(21) Appl. No.: 16/899,189

(22) Filed: Jun. 11, 2020

(65) Prior Publication Data

US 2020/0390182 A1 Dec. 17, 2020

(30) Foreign Application Priority Data

Jun. 14, 2019 (KR) ..... 10-2019-0071058

(51) Int. Cl.
*A42B 3/14* (2006.01)
*A41D 20/00* (2006.01)
*A62B 18/08* (2006.01)

(52) U.S. Cl.
CPC ..... *A42B 3/145* (2013.01); *A41D 20/00* (2013.01); *A42B 3/142* (2013.01); *A62B 18/08* (2013.01)

(58) Field of Classification Search
CPC ..... A42B 3/145; A42B 3/14; A42B 3/147
See application file for complete search history.

(56) References Cited

U.S. PATENT DOCUMENTS 3,047,876 A * 8/1962 Malcom, Jr. ..... A42B 3/145 2/9
6,367,085 B1 * 4/2002 Berg ..... A62B 17/04 2/202
6,966,074 B2 * 11/2005 Huh ..... A42B 3/14 2/416
7,441,282 B2 * 10/2008 Heine ..... A61B 90/50 2/418
8,453,268 B2 * 6/2013 Ahlgren ..... A42B 3/145 2/416
8,505,121 B2 * 8/2013 Ahlgren ..... A42B 3/085 2/418
8,584,265 B2 * 11/2013 Lilenthal ..... A42B 3/14 2/418
8,661,570 B2 * 3/2014 Huh ..... A42B 3/122 2/418
8,850,624 B2 * 10/2014 Gleason ..... A42B 3/085 2/181
8,875,318 B2 * 11/2014 Huh ..... A61B 90/35 2/416
9,907,348 B2 3/2018 Huh
10,016,008 B2 * 7/2018 Sommers ..... A42B 3/085
10,111,486 B2 * 10/2018 Gotti ..... A42B 3/08
(Continued)

FOREIGN PATENT DOCUMENTS

CN 106264862 A 1/2017
CN 106455739 A 2/2017
(Continued)

*Primary Examiner* — Alissa L Hoey

(74) *Attorney, Agent, or Firm* — KILPATRICK TOWNSEND & STOCKTON LLP

(57) ABSTRACT

Provided is a head band including a band main body, a supporting band, and an adjusting band, wherein the supporting band may stably support a head of a wearer by contacting and supporting the head at two or more points, and the length of the head band may be adjusted for improved wearing convenience.

4 Claims, 19 Drawing Sheets

(56) References Cited

U.S. PATENT DOCUMENTS

| | | | | |
|---|---|---|---|---|
| 10,149,509 | B2 * | 12/2018 | Huh | A42B 3/085 |
| 10,194,710 | B2 * | 2/2019 | Huh | A42B 3/085 |
| 10,362,828 | B2 * | 7/2019 | Wu | H01F 7/0242 |
| 10,405,598 | B2 * | 9/2019 | Gotti | A42B 3/14 |
| 10,441,019 | B2 * | 10/2019 | Huh | A42B 3/14 |
| 10,463,100 | B2 * | 11/2019 | Gotti | A42B 3/08 |
| D870,977 | S * | 12/2019 | Berggren | D29/102 |
| 11,147,333 | B2 * | 10/2021 | Wu | A42B 3/145 |
| 2013/0111648 | A1 * | 5/2013 | Huh | A42B 3/145 2/181 |
| 2013/0239302 | A1 | 9/2013 | Ahlgren et al. | |
| 2014/0259286 | A1 * | 9/2014 | Boyle | A41D 20/00 2/181 |
| 2017/0150771 | A1 * | 6/2017 | Huh | A42B 3/14 |
| 2017/0238643 | A1 * | 8/2017 | Pereira | A42B 3/20 |
| 2018/0042330 | A1 * | 2/2018 | Wu | A42B 3/14 |
| 2018/0042774 | A1 * | 2/2018 | Wu | A42B 1/008 |
| 2019/0343213 | A1 * | 11/2019 | Wu | H01F 7/0242 |
| 2021/0153594 | A1 * | 5/2021 | Rogers | A42B 3/142 |
| 2021/0267804 | A1 * | 9/2021 | Huh | A61F 9/06 |
| 2021/0378868 | A1 * | 12/2021 | Huh | A61F 9/06 |
| 2021/0381639 | A1 * | 12/2021 | Howard | G06F 1/163 |
| 2022/0039499 | A1 * | 2/2022 | Brose | A42B 1/002 |

FOREIGN PATENT DOCUMENTS

| | | | |
|---|---|---|---|
| CN | 106572716 | A | 4/2017 |
| DE | 20312928 | U1 | 11/2003 |
| EP | 2589309 | A1 | 5/2013 |
| EP | 3281545 | B1 | 3/2019 |
| FR | 3033475 | A1 | 4/2019 |
| KR | 20150131549 | A | 11/2015 |
| KR | 101932245 | B1 | 12/2018 |
| WO | 2005/016047 | A1 | 2/2005 |

* cited by examiner

HEAD BAND

CROSS-REFERENCE TO RELATED APPLICATION

This application claims the benefit of Korean Patent Application No. 10-2019-0071058, filed on Jun. 14, 2019, in the Korean Intellectual Property Office, the disclosure of which is incorporated herein in its entirety by reference.

BACKGROUND

1. Field

One or more embodiments relate to a head band, and more particularly, to a head band capable of stably supporting a wearer's head and improving wearing convenience.

2. Description of Related Art

In general, industrial safety equipment such as a welding mask, a security mask, a hard hat, or a helmet are products used in various industrial sites such as construction sites and civil engineering sites, and medical head protectors, safety hats, or medical helmets are medical supplies for preventing safety accidents that may occur while workers or wearers are performing tasks.

From among those, a welding mask may protect the eyesight and the face of a worker's from a safety accident that a welding base material splashes onto the face of the worker during a task when the worker wears the welding shield.

A welding mask includes a welding shield for protecting the face of a worker and a head band for wearing the welding mask on the head of the worker. A welding mask includes a welding shield in which a see-through window for protecting the eyesight and the face of a worker from safety accidents when worn by the worker and a head band provided to fix the welding shield to the head of the worker.

Such a head band is formed, such that a band main body that surrounds the head of a wearer is in close contact with the forehead and includes a first support band and a second support band to cover the frontal region and the occipital region of the head. The head band is provided with a length adjusting lever to contact the occipital region of a wearer, and the length adjusting lever is connected to an end portion of the band main body through a length adjustment band. The length adjusting lever has a length adjustment band coupled to an end portion of the band main body.

A cushion member that is formed to be concave from the top, the bottom, the left, and the right toward the center is attached to an inner side surface of the length adjusting lever to be in close contact with the occipital region of the wearer. As the cushion member is provided on the inner side surface of the length adjusting lever, when a worker wears the head band, the cushion member covers the occipital region of the worker, thereby providing convenience and comfort when wearing a welding shield including a head band.

Since the head band is configured that the first support band and the second support band directly contact a specific portion of the head of a wearer, the wearing comfort is deteriorated. Also, as the first support band and the second support band press only specific portions of the head for a long time, discomfort and headache may occur when wearing the head band for a long time.

SUMMARY

One or more embodiments provide a head band that capable of stably supporting the upper portion of the head of a wearer by contacting and supporting the head at two or more points and is length adjustable for improved wearing convenience.

However, these problems are exemplary, and the scope of one or more embodiments is not limited thereby.

Additional aspects will be set forth in part in the description which follows and, in part, will be apparent from the description, or may be learned by practice of the presented embodiments of the disclosure.

According to one or more embodiments, a head band includes a band main body coupled to a helmet and including a front supporting unit that contacts and supports a front surface of a head; a supporting band rotatably coupled to the band main body and contacting and supporting an upper portion of the head; and an adjusting band, which faces the front supporting unit, is coupled to the band main body, contacts and supports a rear surface of the head, and is length-adjustable, wherein the supporting band includes a single supporting band main body of which both end portions are coupled to the band main body; and a contacting portion, which is connected to the supporting band main body and contacts and supports the upper portion of the head at two or more points.

The front supporting unit may include a plurality of front supporting main bodies, which are arranged side by side and apart from one another; and a front adjusting unit configured to connect the plurality of the front supporting main body.

A cut portion may be formed at the front supporting main body to open the center portion thereof, and the front adjusting unit may be coupled to a predetermined region of the front supporting main body having formed thereat the cut portion.

A front supporting wing may protrude from side portions of the front supporting main body around a lengthwise direction of the front supporting main body.

The contacting portion may include a moving main body configured to be movable on the supporting band main body; and a plurality of supporting portions, which are coupled to the moving main body and are arranged on both sides around an axis in a lengthwise direction of the supporting band main body.

The adjusting band may include an adjusting band main body coupled to the band main body; a rear adjusting main body coupled to the adjusting band main body and adjusting a length of the adjusting band main body; a base configured to contact and support a rear surface of a head; and a base connector configured to connect between the rear adjusting main body and the base and separate the rear adjusting main body and the base from each other.

Other aspects, features, and advantages will become apparent from the following drawings, claims, and detailed description of the invention.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
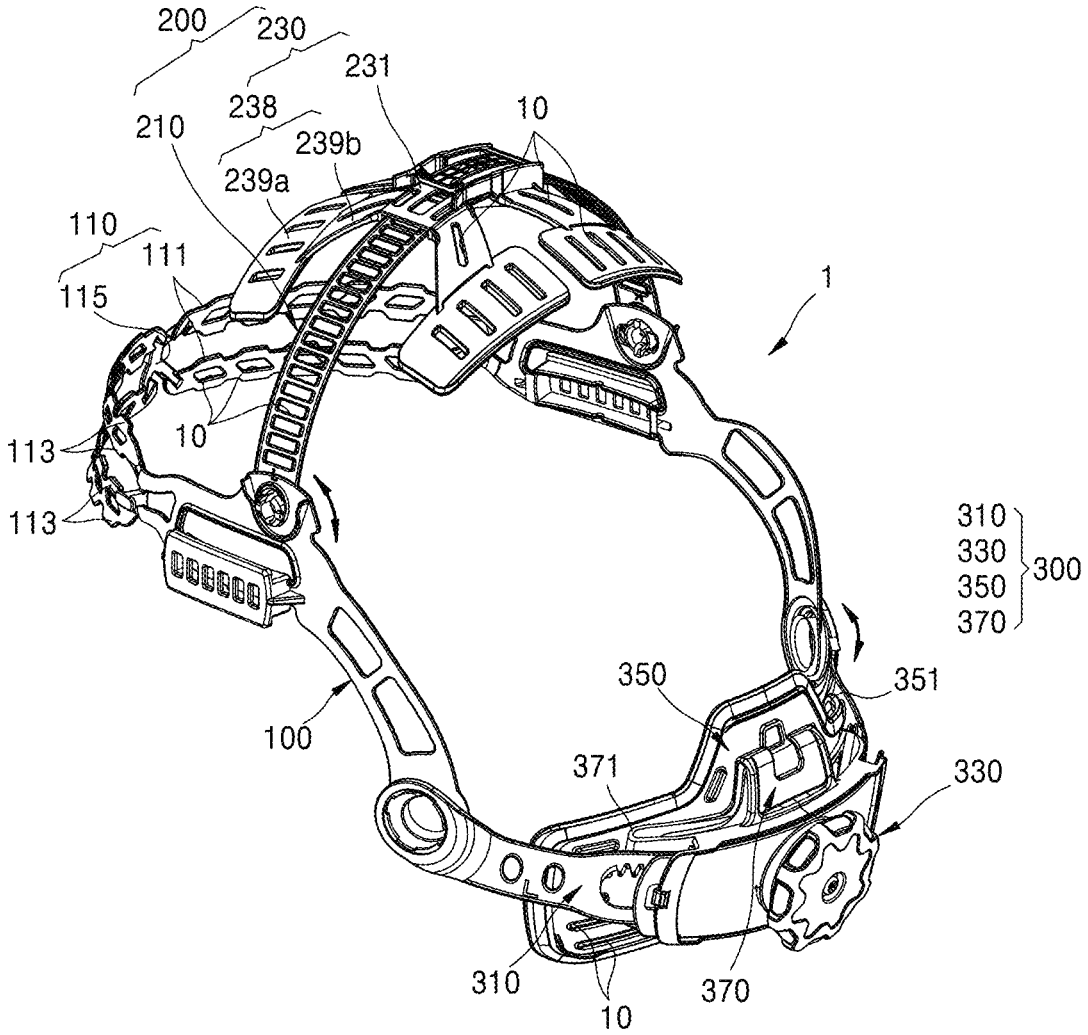
FIG. 1 is a perspective view of a head band according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

The one or more embodiments may include various embodiments and modifications, and embodiments thereof will be illustrated in the drawings and will be described herein in detail. The effects and features of one or more embodiments and the accompanying methods thereof will become apparent from the following description of the embodiments, taken in conjunction with the accompanying drawings. However, one or more embodiments are not limited to the embodiments described below, and may be embodied in various modes.

Reference will now be made in detail to embodiments, examples of which are illustrated in the accompanying drawings. In the drawings, the same elements are denoted by the same reference numerals, and a repeated explanation thereof will not be given.

It will be understood that although the terms "first", "second", etc. may be used herein to describe various elements, these elements should not be limited by these terms. These elements are only used to distinguish one element from another.

As used herein, the singular forms "a," "an" and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components.

It will be understood that when a layer, region, or component is referred to as being "formed on" another layer, region, or component, it can be directly or indirectly formed on the other layer, region, or component. That is, for example, intervening layers, regions, or components may be present.

Sizes of elements in the drawings may be exaggerated for convenience of explanation. In other words, since sizes and thicknesses of components in the drawings are arbitrarily illustrated for convenience of explanation, the following embodiments are not limited thereto.

When a certain embodiment may be implemented differently, a specific process order may be performed differently from the described order. For example, two consecutively described processes may be performed substantially at the same time or performed in an order opposite to the described order.

In the specification, when a film, region, or component is connected to another film, region, or component, the films, regions, or components may not only be directly connected, but may also be indirectly connected via an intervening film, region, or component therebetween. For example, when a film, region, component is electrically connected to another film, region, or component, the films, regions, or components may not only be directly electrically connected, but may also be indirectly electrically connected via an intervening film, region, or component therebetween.

Figure 2:
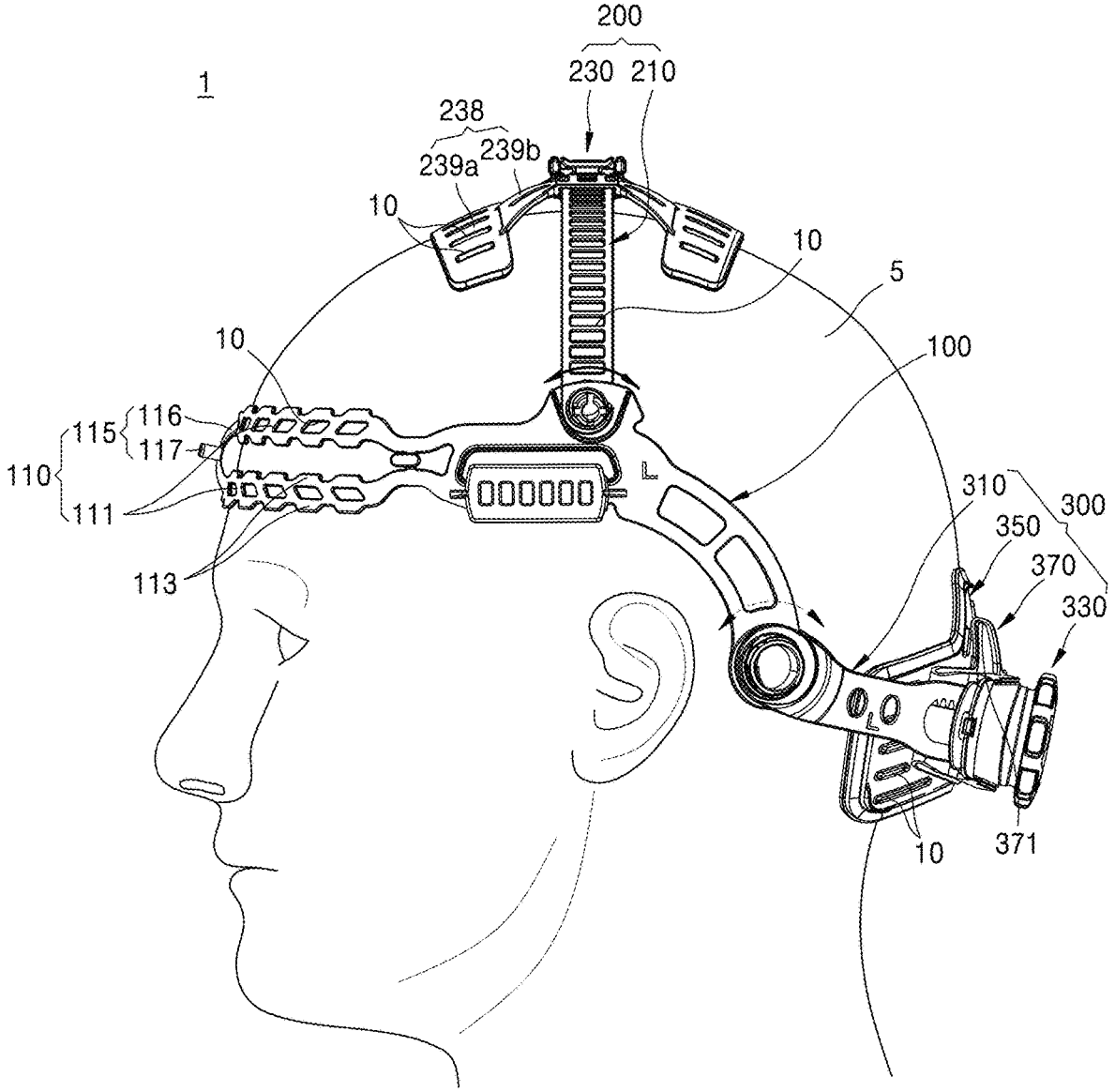
FIG. 2 is a side view showing a state of wearing a head band according to an embodiment.
Figure 3:
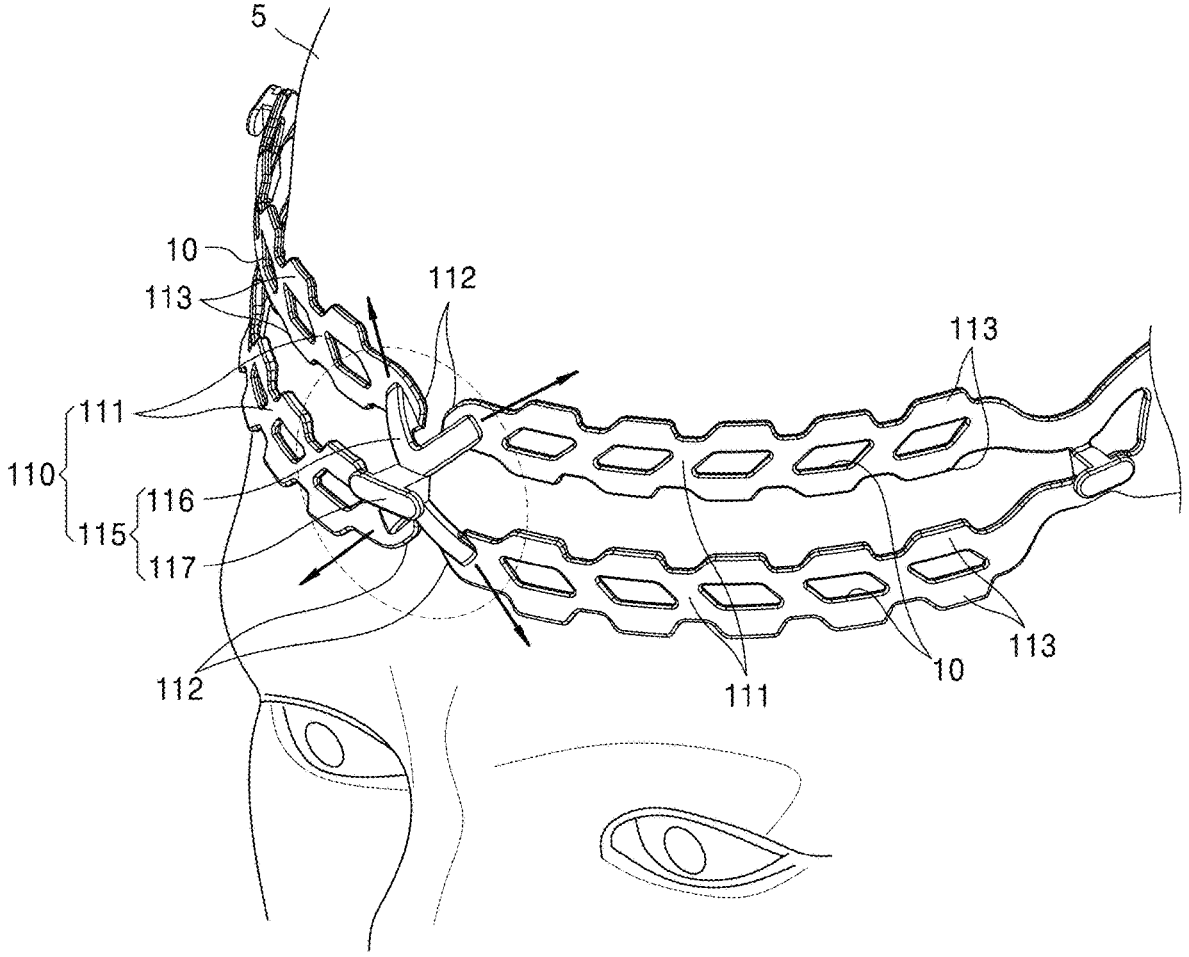
FIG. 3 is a partial perspective view of a front supporting unit according to an embodiment.
Figure 4A:
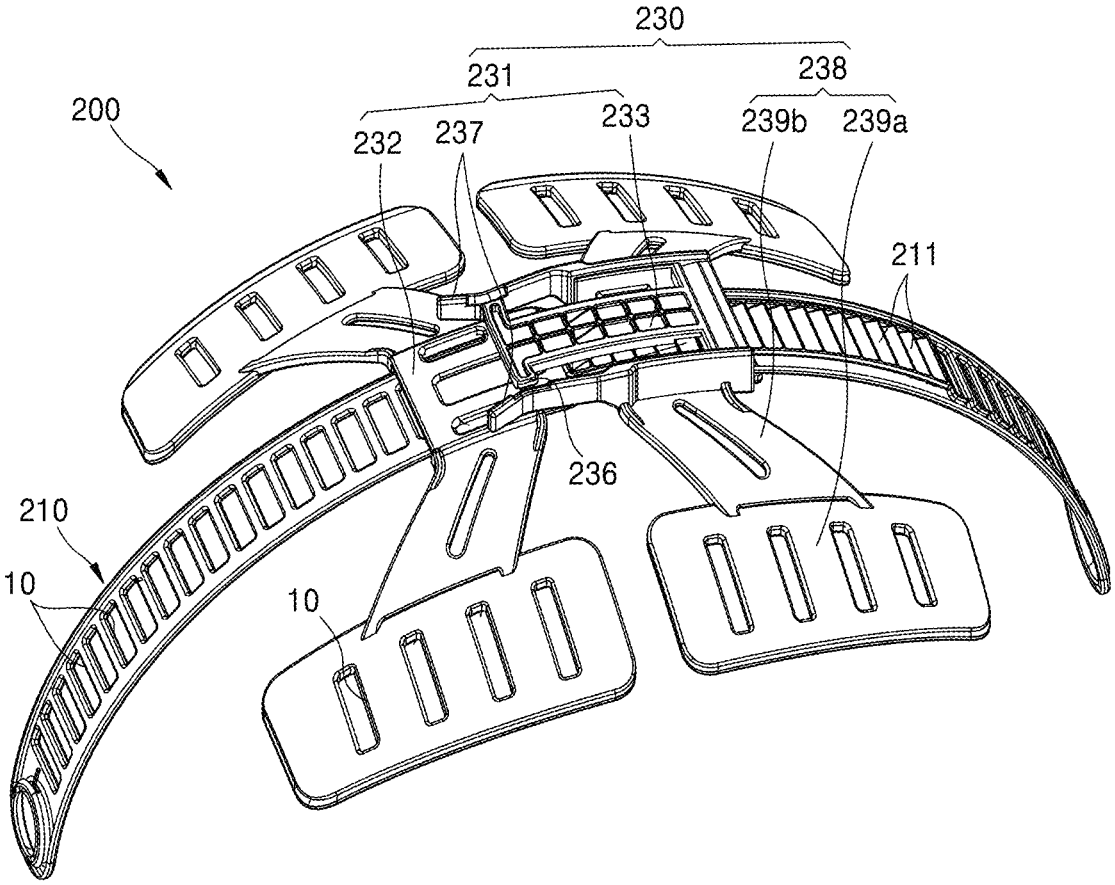
FIG. 4A is a perspective view of a supporting band according to an embodiment.
Figure 5:
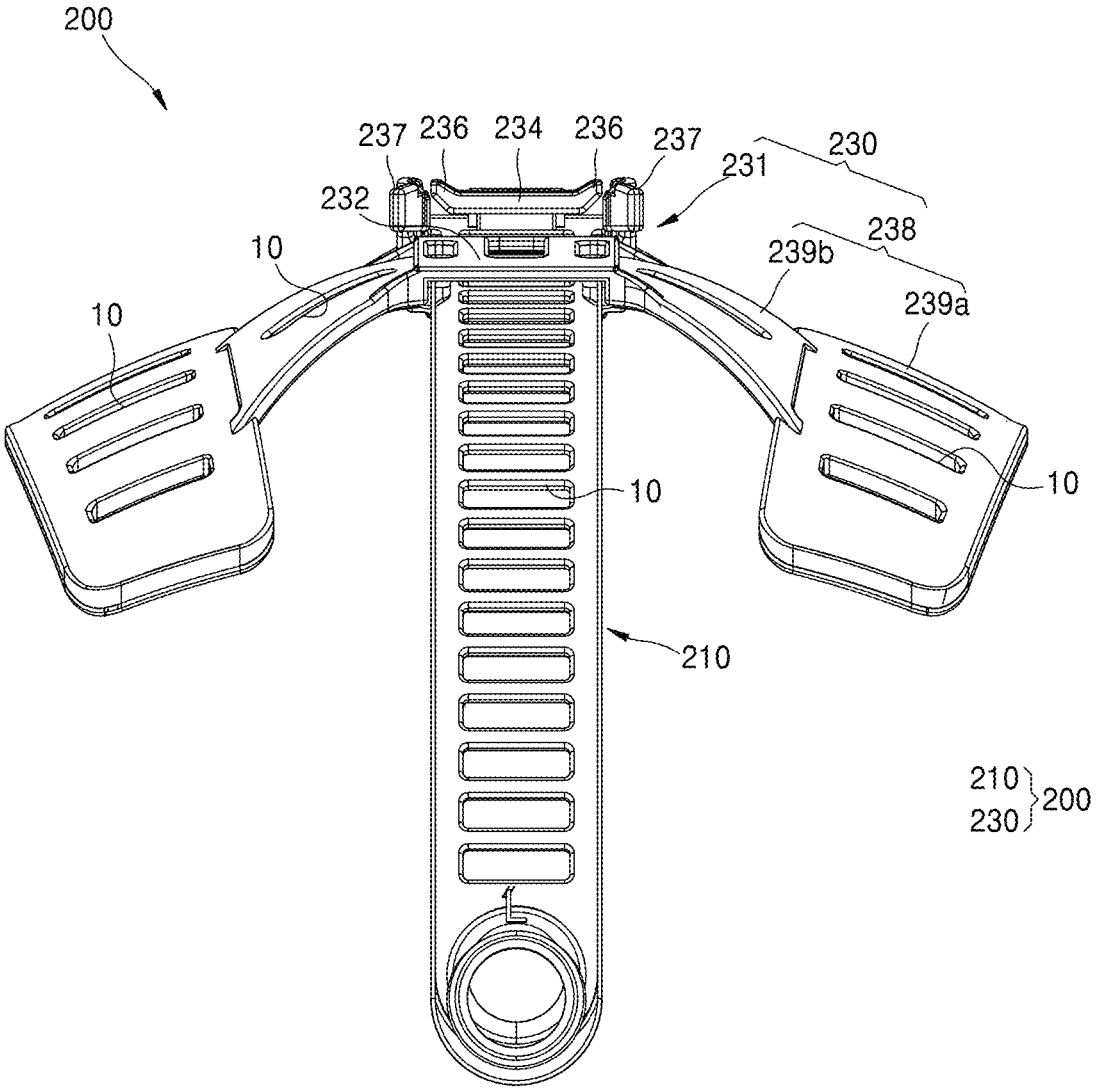
FIG. 5 is a side view of a supporting band according to an embodiment.
Figure 6A:
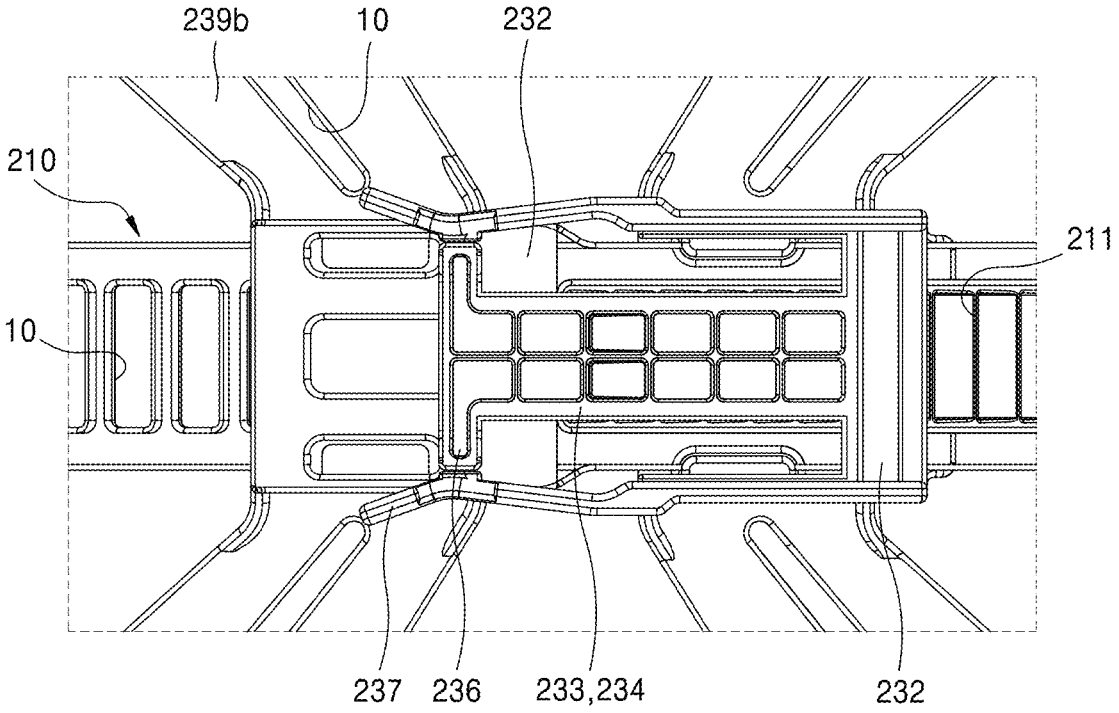
FIGS. 6A to 6C are views showing a state in which a contacting portion according to an embodiment is positioned and fixed on a supporting band main body.
Figure 6B:
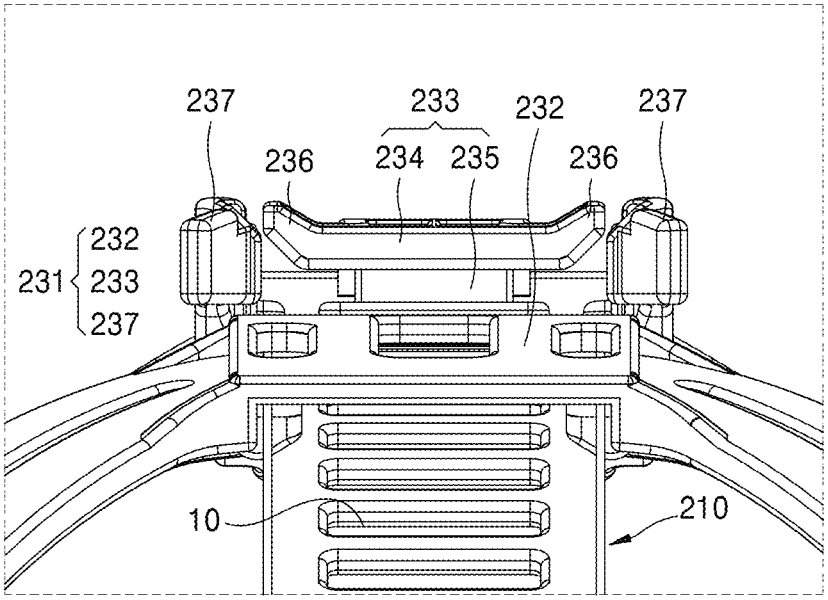
Figure 6C:
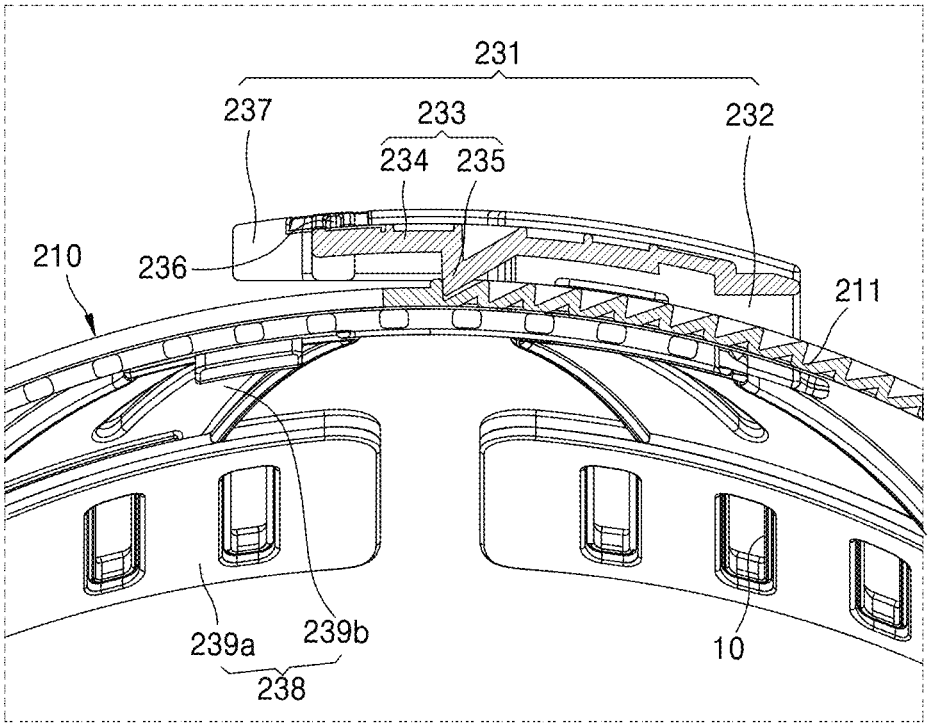
Figure 7A:
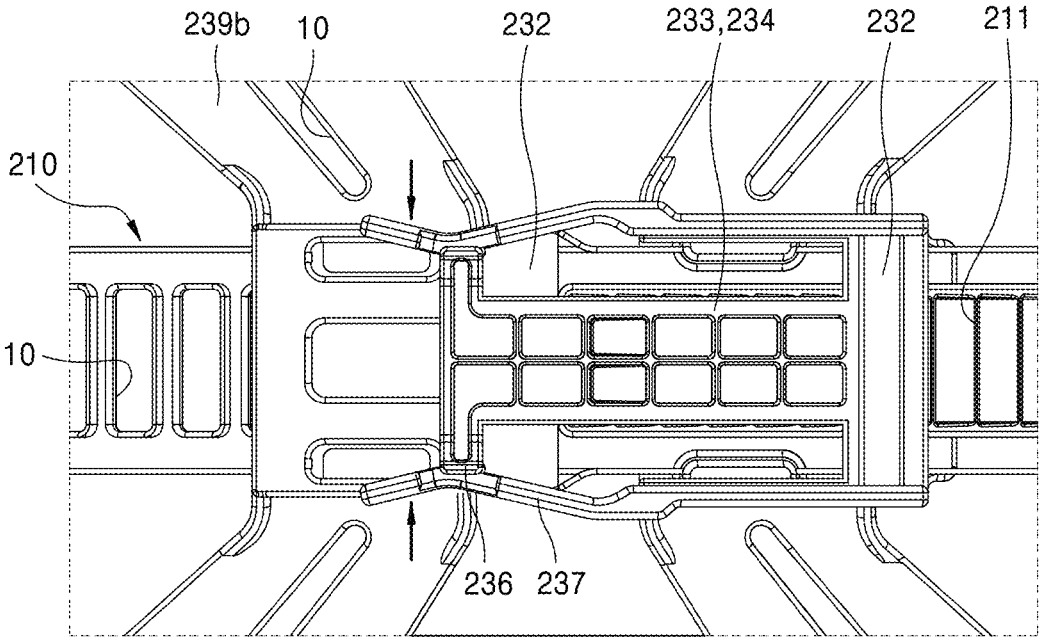
FIGS. 7A to 7C are views showing a state in which a contacting portion according to an embodiment is moved on a supporting band main body.
Figure 7B:
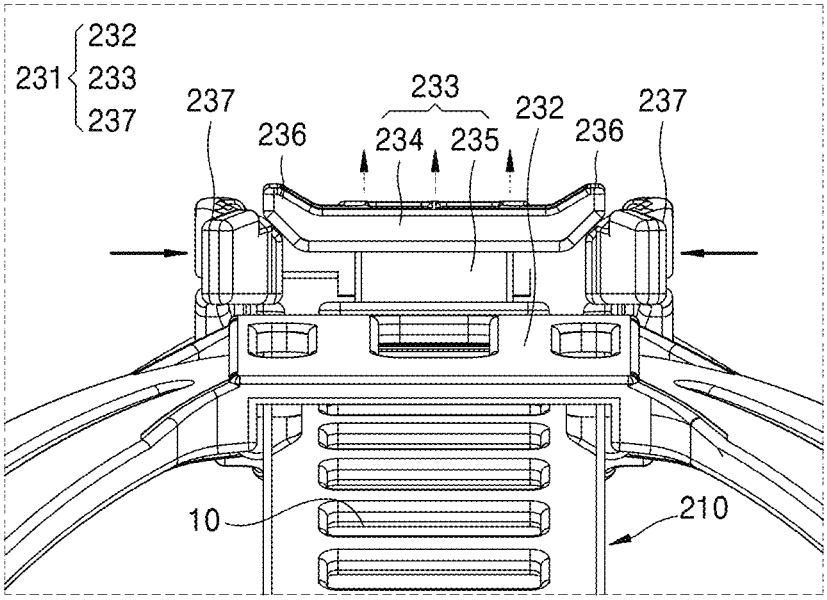
Figure 7C:
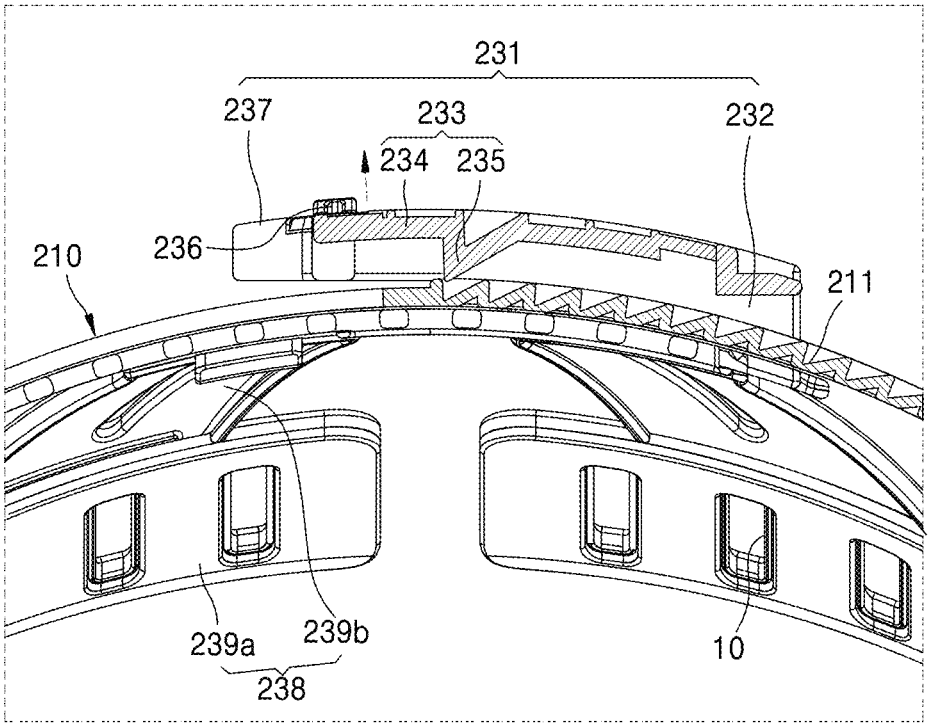
Figure 8:
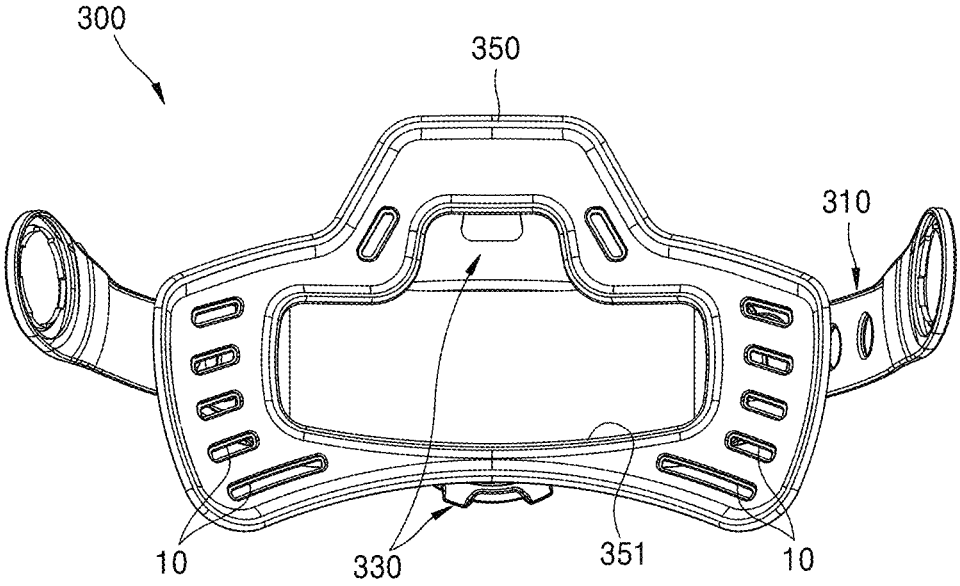
FIG. 8 is a front view of an adjusting band according to an embodiment.
Figure 9:
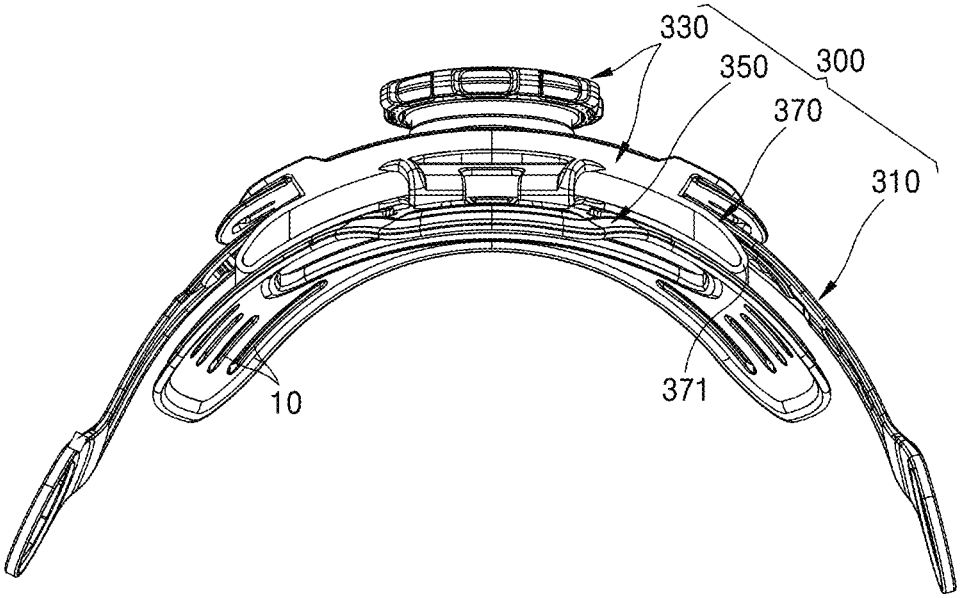
FIG. 9 is a plan view of an adjusting band according to an embodiment.
Figure 10:
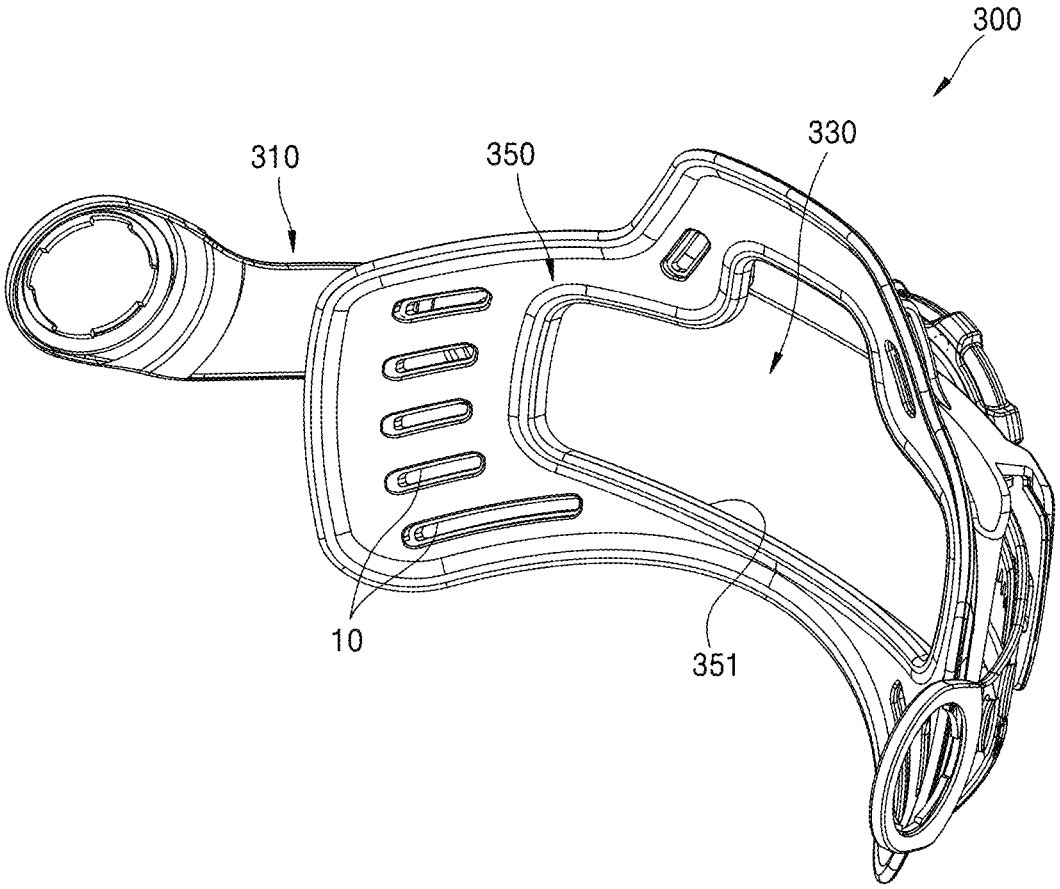
FIG. 10 is a front perspective view of an adjusting band according to an embodiment.
Figure 11:
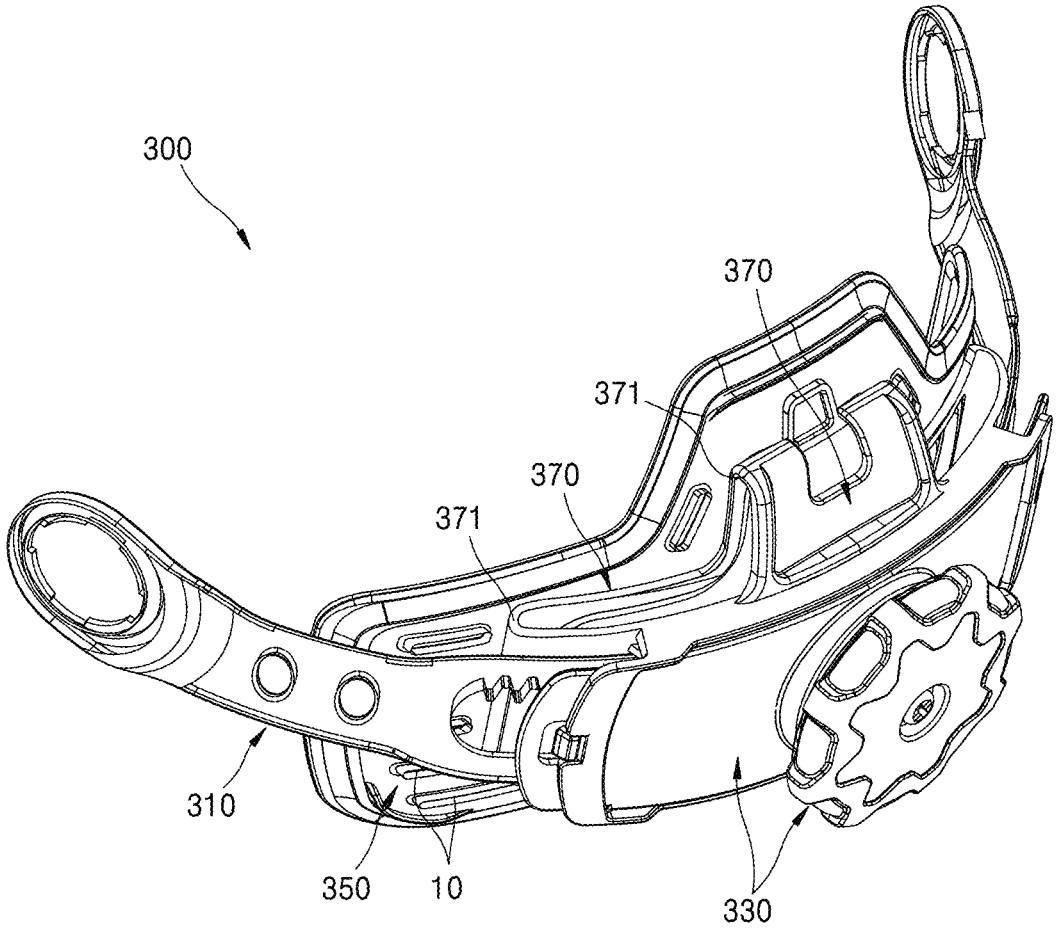
FIG. 11 is a rear perspective view of an adjusting band according to an embodiment.
Figure 12:
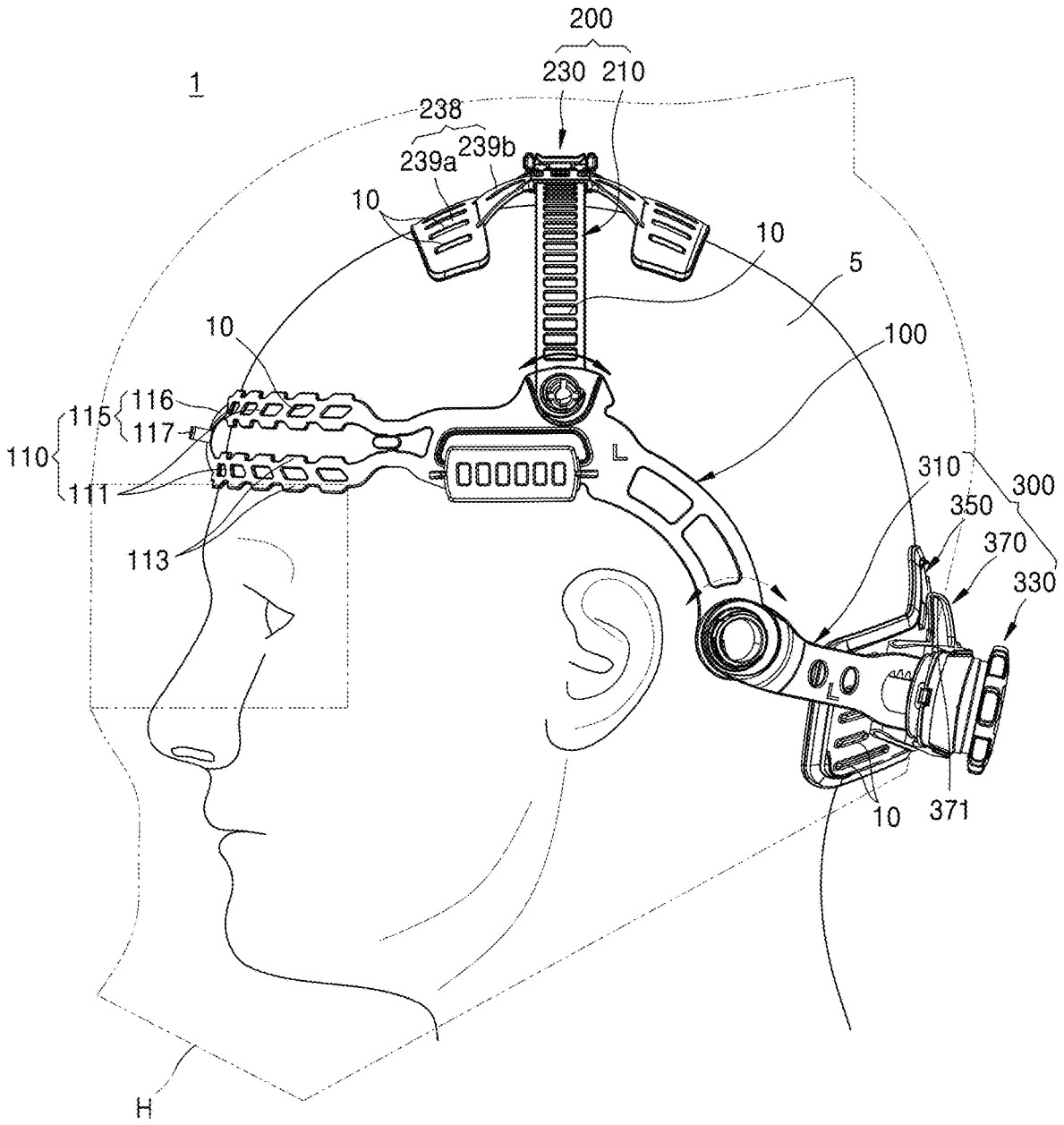
FIG. 12 is a side view showing a state in which a head band according to an embodiment is coupled to a helmet.

FIG. 1 is a perspective view of a head band according to an embodiment. FIG. 2 is a side view showing a state of wearing a head band according to an embodiment. FIG. 3 is a partial perspective view of a front supporting unit according to an embodiment. FIG. 4A is a perspective view of a supporting band according to an embodiment. FIG. 5 is a side view of a supporting band according to an embodiment. FIGS. 6A to 6C are views showing a state in which a contacting portion according to an embodiment is positioned and fixed on a supporting band main body. FIGS. 7A to 7C are views showing a state in which a contacting portion according to an embodiment is moved on a supporting band main body. FIG. 8 is a front view of an adjusting band according to an embodiment. FIG. 9 is a plan view of an adjusting band according to an embodiment. FIG. 10 is a front perspective view of an adjusting band according to an embodiment. FIG. 11 is a rear perspective view of an adjusting band according to an embodiment. FIG. 12 is a side view showing a state in which a head band according to an embodiment is coupled to a helmet.

Referring to FIGS. 1 to 4A, 11, and 12, a head band 1 according to an embodiment may include a band main body 100, a supporting band 200, and an adjusting band 300.

Referring to FIGS. 1 to 3 and 12, the band main body 100 according to an embodiment is coupled to a helmet H and may include a front supporting unit 110, which contacts and support a front surface of a head 5 of a wearer, that is, the forehead.

Referring to FIGS. 1 to 3, the front supporting unit 110 according to an embodiment may be formed in front of the band main body 100 to be able to contact-support an upper portion of the head 5 of a wearer wearing the head band 1, and more particularly, the forehead of the wearer. The front supporting unit 110 may include a front supporting main body 111 and a front adjusting unit 115.

Referring to FIGS. 1 to 3, a plurality of front supporting main bodies 111 according to an embodiment may be provided and arranged in parallel with each other.

Therefore, compared to a case where a single front supporting main body 111 is formed, the number of points of contact with the front surface of the head 5 of the wearer increases, and thus the contact-support becomes firmer and the position of the head band worn on the head 5 of the wearer is stably fixed.

Although a plurality of front supporting main bodies 111 are arranged side by side in parallel according to one or more embodiments, one or more embodiments are not limited thereto, and various modifications may be made therein. For example, the plurality of front supporting main bodies 111 may be arranged to cross each other, and more particularly, arranged in an 'X'-shape, such that the positions of the front supporting main bodies 111 may be adjusted according to shapes of the left portion and the right portion of the head 5 of the wearer.

Although two front supporting main bodies 111 are formed in one or more embodiments, one or more embodiments are not limited thereto, and various modifications may be made therein. For example, three or more front supporting main bodies 111 may be formed. Hereinafter, descriptions will be given based on a case in which the two front supporting main bodies 111 are formed.

Referring to FIGS. 2 and 3, the plurality of front supporting main bodies 111 arranged in parallel may be connected to each other by the front adjusting unit 115 described later. The plurality of front supporting main bodies 111 may be integrally formed by being connected to each other at both ends around the center portions.

Referring to FIG. 3, in the front supporting main body 111 according to an embodiment, a cut portion 112 may be formed, such that the center portion of the front supporting main body 111 is opened.

In one or more embodiments, the cut portion 112 is formed at the center portion of the front supporting main body 111. However, one or more embodiments are not limited thereto, and the cut portion 112 may be formed in a preset region to the left or to the right around the center portion of the forehead of the wearer (see FIG. 3).

Front adjusting units 115 are formed at end portions of the plurality of front supporting main bodies 111 having formed therein cut portions 112. Therefore, the wearer may adjust locations on the front surface of the head 5 of the wearer (more particularly, the forehead region) closely contacted by the plurality of front supporting main bodies 111 by holding the front adjusting unit 115 and adjusting the same clockwise or counterclockwise, Referring to FIGS. 1 to 3, at least one hole 10 may be formed in the front supporting main body 111 according to an embodiment. As the hole 10 is formed, sweat from the head 5 of the wearer may be discharged during welding, for example.

Furthermore, ventilation may be expected by allowing the outside air to pass through the hole 10 to be transmitted to the head 5 of the wearer.

Referring to FIG. 3, various modifications may be made in one or more embodiments. For example, the front supporting main body 111 may be formed integrally with the front adjusting unit 115 or the front supporting main body 111 may be formed separately from the front adjusting unit 115 and coupled to the front adjusting unit 115.

Referring to FIGS. 1 to 3 and 12, front supporting wings 113 according to an embodiment are formed on the front supporting main body 111 and may protrude from side portions (top surfaces and bottom surfaces in FIG. 3) of the front supporting main body 111 around the lengthwise direction of the front supporting main body 111.

The front supporting wings 113 according to an embodiment may be formed at end portions of the side portions of the front supporting main body 111 to be inclined toward the front surface of the head 5 of the wearer, that is, the forehead region.

Therefore, the front supporting main body 111 extending in the lengthwise direction is spaced apart from the forehead region by a predetermined interval. As a result, the air may flow through the space formed between the front supporting main body 111 and the forehead region, thereby preventing sweating and improving the wearing comfort.

Furthermore, the front supporting wings 113 are formed on both side portions of the front supporting main body 111 around the lengthwise direction (the top surface and the bottom surface of the front supporting main body 111 in FIG. 3) to closely contact the front surface of the head 5 of the wearer, thereby supporting the head 5 of the wearer and preventing random dislocation and detachment of the front supporting unit 110 (more particularly, the front supporting main body 111).

Referring to FIGS. 1 to 3, a plurality of front supporting wings 113 according to an embodiment may be provided, and the plurality of front supporting wings 113 may be spaced apart at predetermined intervals.

Due to the formation of the plurality of front supporting wings 113, the front supporting unit 110 may be closely attached to the front surface of the head 5 of the wearer, and more particularly, the forehead region, and the head band 1 coupled to the helmet H may be stably fixed.

The front supporting wing 113 according to an embodiment may include an elastic material. Therefore, it is possible to cope with minute movements occurring in the head band 1 during a task like welding, and the front supporting wing 113 may stably contact and support the front surface of the head 5 of the wearer.

Referring to A of FIG. 2, the front supporting wings 113 formed on both sides of the front supporting main body 111 according to an embodiment around the lengthwise direction (the upper end portion and the lower end portion in FIG. 2) may be formed to be inclined in directions opposite to each other.

In detail, the front supporting wing 113, which protrudes from the upper end (in to FIG. 2) of the front supporting main body 111 around the lengthwise direction, may protrude to be inclined to be able to contact the forehead of a wearer, whereas the front supporting wing 113, which protrudes from the lower end (in to FIG. 2) of the front supporting main body 111 around the lengthwise direction, may be inclined in a direction away from the face of the wearer (more particularly, eyebrows).

Referring to A of FIG. 2, the front supporting wing 113 in a region closed to an eyeball and an eyebrow of a wearer (in particular, the front supporting wing 113 protruding from the lower end (in FIG. 2) of the front supporting main body 111) is formed to be inclined in a direction away from the face of the wearer, thereby contact-supporting the face of the wearer through the front supporting wing 113 formed at the upper end (in FIG. 2) of the front supporting main body 111 and, at the same time, preventing the eyebrow and the eyeball of the wearer from being poked by the front supporting wing 113.

Referring to FIGS. 1 to 3 and 12, the front adjusting unit 115 according to an embodiment connects a plurality of front supporting main bodies 111 and may include front adjusting main body 116 and a front adjusting lever 117.

Referring to FIG. 3, the front adjusting unit 115 according to an embodiment may be coupled to a predetermined region of the front supporting main body 111 having formed therein the cut portion 112.

Referring to FIG. 3, the front adjusting main body 116 may be coupled to the plurality of front supporting main bodies 111, and the front adjusting lever 117 may share the center with the front adjusting main body 116 and coupled to the front adjusting main body 116.

In one or more embodiments, two front supporting main bodies 111 are arranged side by side, and the front adjusting main body 116 may connect the cut portion 112 that is formed to open the center portion of each front supporting main body 111, and more particularly, total four points including opposing end portions of the front supporting main body 111 between which the cut portion 112 of one front supporting main body 111 is formed and opposing end portions of the front supporting main body 111 between which the cut portion 112 of another front supporting main body 111 is formed.

In detail, referring to FIG. 3, the front adjusting main body 116 is formed in an 'X' shape, and thus end portions of the front adjusting main body 116 may be connected to four points of the front supporting main bodies 111 between which the cut portions 112 are formed.

Therefore, the front supporting main body 111 may be in close contact with the front surface of the head 5 of the wearer, and more particularly, the forehead region, without being lifted in vertical and horizontal directions.

Furthermore, the wearer may hold the front adjusting unit 115 formed in an 'X' shape, and more particularly, the front adjusting lever 117 and move front supporting unit 110 according to shapes of the left portion and the right portion of the head 5 of the wearer (in FIG. 3).

Referring to FIG. 3, the front adjusting lever 117 according to an embodiment shares the center with the front adjusting main body 116 and may be formed as a straight bar.

The wearer holds the bar and rotates the bar clockwise or counterclockwise, thereby separating the front supporting main body 111, which is in close contact with the front surface of the head 5 of the wearer (more particularly, the forehead region), from the forehead region and changing a location of the forehead region with which the front supporting unit 110 (more particularly, the front supporting main body 111) is in close contact.

Since the front adjusting main body 116 according to an embodiment is formed in an 'X' shape, the center of the front adjusting main body 116 is located between the plurality of front supporting main bodies 111, and, as the front adjusting main body 116 is rotated clockwise or counterclockwise around the center of the front adjusting main body 116, the plurality of front supporting main bodies 111 are adjusted, thereby preventing the front supporting unit 110 from being lifted and detached from the front surface of the head 5 of the wearer.

Referring to FIGS. 1, 2, 4A, 5, 6A to 6C, and 7A to 7C, the supporting band 200 according to an embodiment may be rotatably coupled to the band main body 100. The supporting band 200 may contact and support the upper portion of the head 5 of the wearer.

The supporting band 200 according to an embodiment may include a supporting band main body 210 and a contacting portion 230.

Referring to FIGS. 1, 2, 4A, 5, 6A, and 7A, the supporting band main body 210 according to an embodiment may be integrally formed with the band main body 100 as both end portions of the supporting band main body 210 are coupled to the band main body 100.

Referring to FIGS. 1, 2 and 4A, the supporting band main body 210 according to an embodiment may be formed to have a constant width in the lengthwise direction.

Figure 4B:
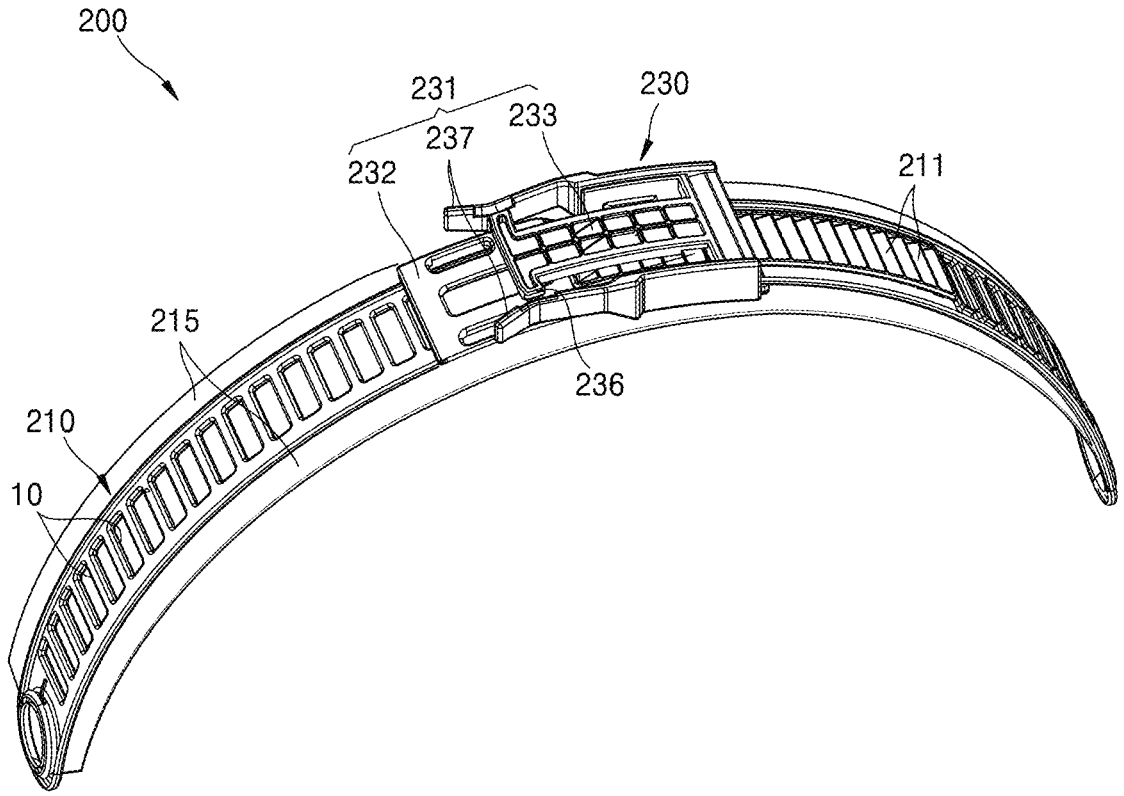
FIGS. 4B to 4D are perspective views of a supporting band main body according to another embodiment.
Figure 4C:
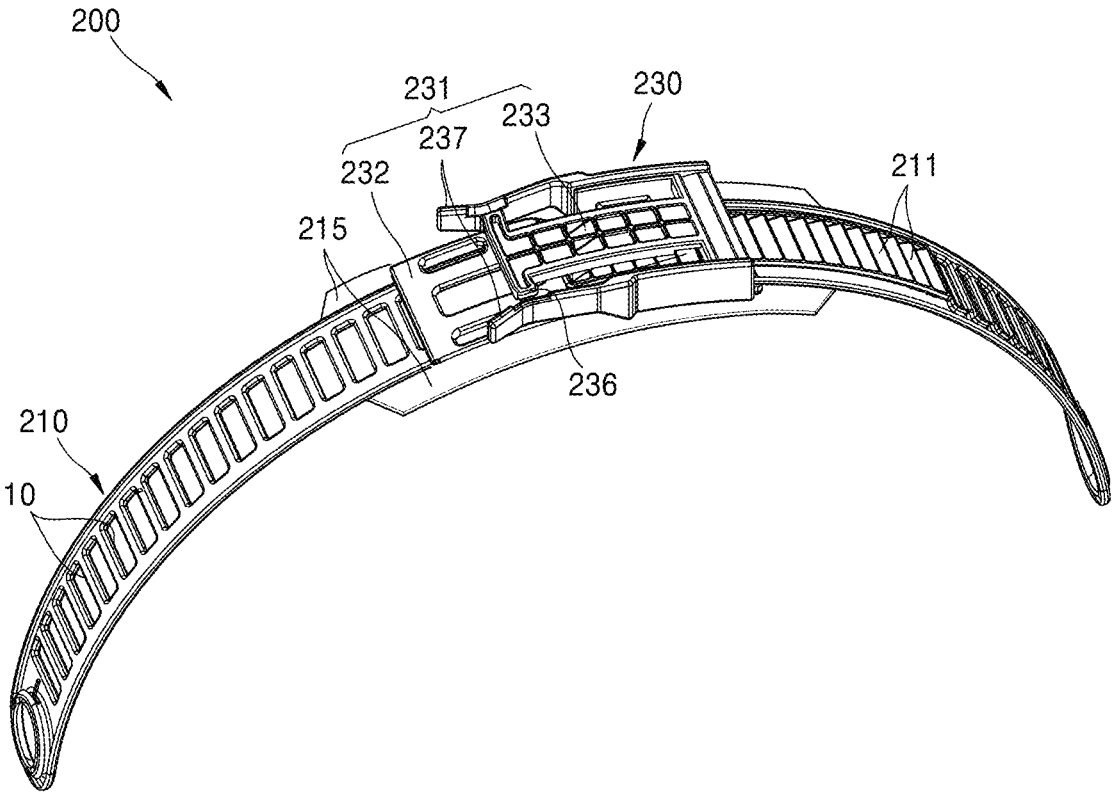
Figure 4D:
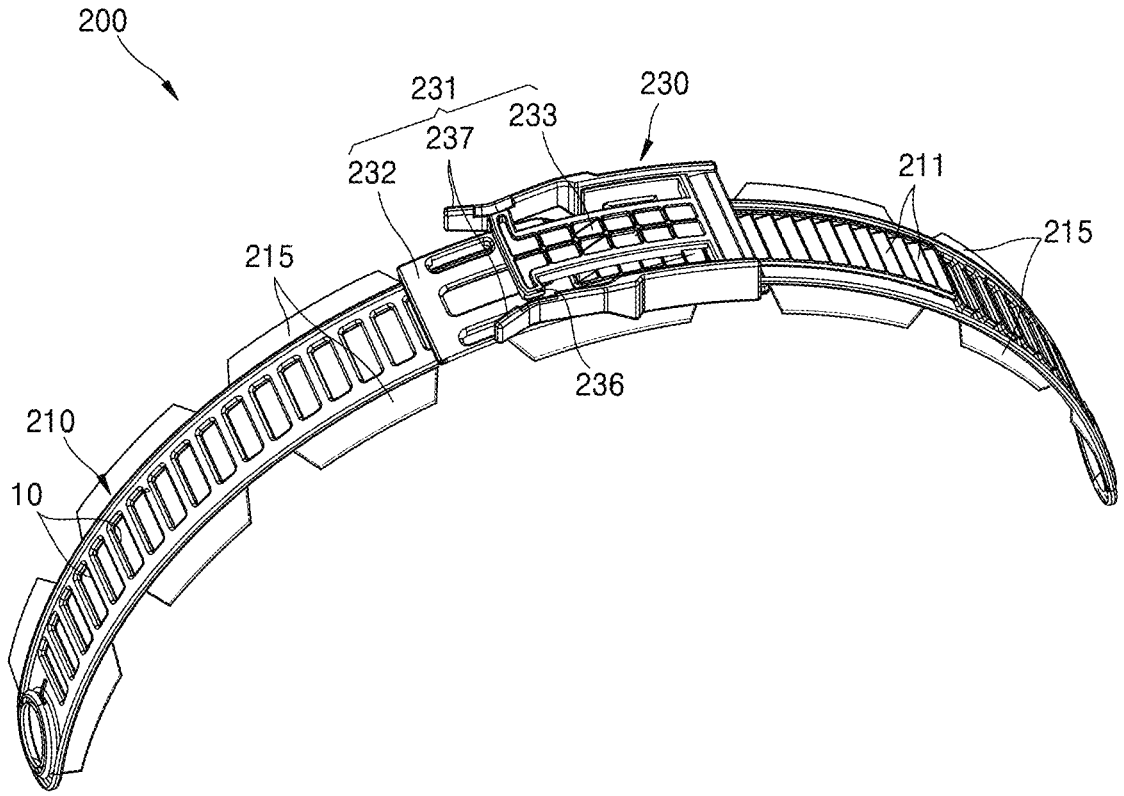

However, one or more embodiments are not limited thereto, and, referring to FIGS. 4B, 4C, and 4D, various modifications may be made therein. For example, a wing 215 extending to both sides in the lengthwise direction of the supporting band main body 210 may be formed.

In detail, the wing 215 may be formed along the entire region of the supporting band main body 210 as shown in FIG. 4B and may be formed, such that a width of the wing 215 in a pre-set region extending to both sides in a predetermined region at the center of the supporting band main body 210 is greater than a width in other regions.

Furthermore, referring to FIG. 4D, a plurality of wings 215 may be formed apart from one another on both sides of the supporting band main body 210 in the lengthwise direction of the supporting band main body 210.

Due to the relatively large width of the wing 215 in the pre-set region of the supporting band main body 210, the area in contact with the head 5 of the wearer increases, a shock absorbing area may increase, and the wearing comfort may be improved.

Furthermore, the wing 215 of FIGS. 4B to 4D may contact and support the head 5 of the wearer instead of a supporting portion 238, thereby improving the wearing comfort of the wearer.

The contacting portion 230 is connected to the supporting band main body 210, may contact and support the upper portion of the head 5 of the wearer at two or more points, and may be moved on the supporting band main body 210. The contacting portion 230 will be described in detail later.

Referring to FIG. 4A, at least one hole 10 may be formed in the supporting band main body 210. As the hole 10 is formed, sweat from the head 5 of the wearer may be discharged during welding, for example. Although not shown in the drawings, at least one hole may also be formed in the wing 215 shown in FIGS. 4B to 4D.

Furthermore, ventilation may be expected by allowing the outside air to pass through the hole 10 to be transmitted to the head 5 of the wearer.

Referring to FIGS. 4A, 6A to 6C, and 7A to 7C, a plurality of adjusting grooves 211 may be formed in the supporting band main body 210. A locking protrusion 235, which will be described later, may be accommodated in or detached from the adjusting grooves 211.

As the locking protrusion 235 formed on the contacting portion 230 is accommodated in or detached from different adjusting grooves 211, the contacting portion 230 may be moved on the supporting band main body 210, and thus the position of the contacting portion 230 contacting and supporting the upper portion of the head 5 of the wearer at two or more points may be adjusted.

The adjusting groove 211 according to an embodiment may be formed in correspondence to the shape of the locking protrusion 235 to be described later, such that the locking protrusion 235 surface-contacts the same.

Referring to FIGS. 6C and 7C, the supporting band main body 210 according to an embodiment includes a first region in which the adjusting groove 211 is formed and a second region in which an adjusting groove 211 is not formed, wherein the first region and the second region overlap each other, and the adjusting groove 211 may be formed in at least one of the first region and the second region.

Referring to FIG. 6*c*, the adjusting groove 211 is formed to have a triangular cross-sectional shape. However, one or more embodiments are not limited thereto, and various modifications may be made therein, e.g., a cross-sectional shape with a curved portion.

A plurality of adjusting grooves 211 may be successively formed in the lengthwise direction of the supporting band main body 210.

Referring to FIGS. 1, 2, 4A, and 5 to 7C, the contacting portion 230 according to an embodiment is connected to the supporting band main body 210, contacts and supports the upper portion of the head 5 of the wearer wearing the head band 1 at two or more points, and may include a moving main body 231 and the supporting portion 238.

The moving main body 231 according to an embodiment may be moved on the supporting band main body 210 and may include a moving plate 232, a lock 233, and a moving lever 237.

Referring to FIG. 4A, the moving plate 232 is coupled to the supporting portion 238 and may move in the lengthwise direction of the supporting band main body 210 on the supporting band main body 210. A first end portion of the lock 233 is coupled to the moving plate 232, and the locking protrusion 235 may protrude toward the adjusting groove 211 (a downward direction in FIG. 6C).

As the first end portion of the lock 233 according to an embodiment is coupled to the moving plate 232, a second end portion of the lock 233 opposite to the first end portion coupled to the moving plate 232 may freely move in the vertical direction (in FIG. 6C).

Normally, the locking protrusion 235 formed on the lock 233 may be accommodated on the adjusting groove 211 formed on the supporting band main body 210, and the position of the locking protrusion 235 may be fixed.

When a wearer wants to move the contacting portion 230 on the supporting band main body 210, the second end of the lock 233 opposite to the first end portion coupled to the moving plate 232 may be moved upward (in FIG. 6C, thereby separating the locking protrusion 235 from the adjusting groove 211 and moving the contacting portion 230 on the supporting band main body 210.

Referring to FIGS. 6A to 7C, the locking protrusion 235 according to an embodiment may be accommodated on or separated from the adjusting groove 211 formed in the supporting band main body 210.

When the locking protrusion 235 is accommodated on the adjusting groove 211, the locking protrusion 235 may only be moved in one direction (the direction from the left to the right in FIG. 7C), and movement in the other direction (the direction from the right to the left in FIG. 7C) may be blocked.

Therefore, when the wearer pushes both sides of the supporting band main body 210 (the left side and the right side in FIG. 7C) with both hands in directions toward each other or pushes the moving main body 231 with one hand, the locking protrusion 235 may move along an inclined surface formed in the adjusting groove 211, and thus the supporting band main body 210 may be tightened in a one touch manner. Referring to FIGS. 7*a* to 7*c*, when the use of the head band 1 is completed and the wearer wants to release the mounting of the head band 1, the contacting portion 230 of the supporting band main body 210, which is in a tightened state, is released in a one touch manner as the wearer presses the moving lever 237 toward the locking protrusion 235, and the contacting portion 230 may slide in an untightening direction (an outward direction from the center in FIG. 7C). Therefore, user convenience may be improved.

Referring to FIGS. 4A and 5 to 7C, the moving lever 237 according to an embodiment is coupled to the moving plate 232 and may be provided outside the lock 233, and more particularly, a lock head 236 formed at the lock main body 234 described later.

A plurality of moving levers 237 may be provided and may be arranged on both sides of the lock 233, and more particularly, the lock main body 234. As the plurality of moving levers 237 are provided, a plurality of lock heads 236 may protrude from the lock main body 237 toward the respective moving levers 237.

The moving lever 237 is capable of pressing the lock 233, such that the locking protrusion 235, which protrudes from the lock main body 234, is accommodated on or separated from the adjusting groove 211.

Referring to FIGS. 6A and 7A, when a wearer presses the moving lever 237 toward the lock head 236, the lock head 236 and the lock 233 having formed thereat the lock head 236 move upward (in FIG. 7C), and the locking protrusion 235 may be separated from the adjusting groove 211.

On the moving lever 237, a groove (no reference numeral is designated) may be formed on one surface facing the lock head 236, and the groove may be formed to be inclined at a predetermined angle.

Therefore, when the wearer presses the moving lever 237 toward the lock head 236, the lock head 236 may be naturally moved upward (in FIG. 7C) along the groove with an inclined surface.

One surface of the lock head 236 facing the groove formed on the moving lever 237 may also be formed to be inclined to face the groove formed on the moving lever 237, and more particularly, the inclined surface of the groove.

As the locking protrusion 235 is separated from the adjusting groove 211, the contacting portion 230 may be moved on the supporting band main body 210, and thus the position of the contacting portion 230 on the upper portion of the head 5 of the wearer may be changed to a desired position.

In other words, the contacting portion 230 may slide on the supporting band main body 210, and thus the wearer may move the contacting portion 230 to a desired position while the wearer is wearing the head band 1 according to an embodiment. Therefore, user convenience may be improved. Referring to FIGS. 4A and 5 to 7C, one end portion of the lock 233 according to an embodiment is coupled to the moving plate 232 and may include the lock main body 234 and the lock head 236.

One end portion of the lock main body 234 is coupled to the moving plate 232, and the locking protrusion 235 may be formed to protrude toward the adjusting groove 211.

Referring to FIGS. 6A to 7C, the lock head 236 according to an embodiment is connected to a second end portion of the lock main body 234 opposite to a first end portion of the lock main body 234 coupled to the moving plate 232 and may extend toward the moving lever 237.

A plurality of lock heads 236 may be formed in correspondence to a plurality of moving levers 237. The lock head 236 may be formed at a position corresponding to the groove formed at the moving lever 237, and one surface of the lock head 236 facing the groove of the moving lever 237 may be formed as an inclined surface.

Since the lock head 236 is formed to have an inclined surface, the lock 233 having formed thereat the lock head 236 may stably move upward (in FIG. 7C) when the lock 233 contacts the moving lever 237, and the locking protrusion 235 may be separated from the adjusting groove 211 formed on the supporting band main body 210 and moved to another adjusting groove 211, thereby moving the contacting portion 230 on the supporting band main body 210.

Referring to FIGS. 4A and 5 to 7C, in one or more embodiments, a plurality of adjusting grooves 211 are provided in the lengthwise direction of the supporting band main body 210, and the lock protrusion 235 is formed to protrude downward (in FIG. 7C) toward the adjusting grooves 211 to be accommodated in each of the adjusting grooves 211, thereby forming a ratchet structure.

However, one or more embodiments are not limited thereto, and various modifications may be made therein. For example, the adjusting grooves 211 may be formed in the lengthwise direction of the supporting band main body 210 to face the lock protrusion 235, and the lock protrusion 235 may be formed to protrude upward (in FIG. 7C) to be accommodated in or separated from the adjusting grooves 211.

Referring to FIGS. 4A and 5 to 7C, the supporting portion 238 according to an embodiment is coupled to the moving main body 231, and a plurality of supporting portions 238 may be provided to be arranged on both sides around the lengthwise direction of the supporting band main body 210.

The supporting portion 238 according to an embodiment may include a supporting main body 239*a* and a supporting connector 239*b*. The supporting main body 239*a* may contact the upper portion of the head 5 of the wearer, and the supporting connector 239*b* may connect the supporting main body 239*a* and the contacting portion 230.

Referring to FIGS. 4A and 5, holes 10 may be formed in the supporting main body 239*a* and the supporting connector 239*b*. Due to the formation of the holes 10 in the supporting main body 239*a* and the supporting connector 239*b*, sweat from the head 5 of the wearer may be discharged during welding, for example.

Furthermore, ventilation may be expected by allowing the outside air to pass through the hole 10 to be transmitted to the head 5 of the wearer.

Since the supporting main body 239*a* is connected to both sides of the moving main body 231 around the lengthwise direction of the supporting band main body 210, the supporting band 200 contacts and supports the upper portion of the head 5 of the wearer at two or more points.

Since the supporting band main body 210 is formed as a single component and the supporting main body 239*a* is connected to both sides of the moving main body 231 based on the lengthwise direction of the supporting band main body 210 and contacts and supports the upper portion of the head 5 of the wearer at two or more points, the weight of the helmet H may be dispersed and the upper portion of the head 5 of the wearer may be stably supported.

Referring to FIGS. 2 and 5, a surface of the supporting main body 239*a* according to an embodiment facing the head 5 (the bottom surface in FIG. 5) is formed in an arch shape, and thus the surface may cover the upper portion of the head 5 of the wearer. Therefore, the wearer may comfortably wear the head band 1, and more particularly, the supporting band 200.

The supporting main body 239*a* according to an embodiment includes a soft material like thermoplastic polyurethane (TPU), and thus wearing convenience of a wearer may be improved.

In one or more embodiments, a total of four supporting main bodies 239*a* are connected to both sides of the moving main body 231 around the lengthwise direction of the supporting band main body 210 (two supporting main bodies 239*a* are connected to each side of the moving main body 231), and four supporting portions 238 contact and support the head 5 of the wearer at four points. However, one or more embodiments are not limited thereto, and various modifications may be made therein. For example, the head 5 of the wearer may be contacted and supported at two points, three points, or five or more points.

Referring to FIGS. 1, 2, and 8 to 12, the adjusting band 300 according to an embodiment faces the front supporting unit 110, is coupled to the band main body 100, contacts and supports the rear surface of the head 5, and may be length-adjusted.

The adjusting band 300 may include an adjusting band main body 310, a rear adjusting main body 330, a base 350, and a base connector 370. The adjusting band 300 is rotatably coupled to the band main body 100 and may adjust a contact position on the rear surface of the head 5 of the wearer.

Referring to FIGS. 8 to 11, the adjusting band main body 310 of one or more embodiments is rotatably coupled to the band main body 100 may be rotated clockwise or counterclockwise around a portion connected to the band main body 100.

Referring to FIGS. 8 to 11, the rear adjusting main body 330 according to an embodiment is coupled to the adjusting band main body 310 and may adjust the length of the adjusting band main body 310. In one or more embodiments, a rotatable lever is installed at the rear adjusting main body 330, and thus the wearer may increase or reduce the length of the adjusting band main body 310 by rotating the lever clockwise or counterclockwise.

However, one or more embodiments are not limited thereto, and various modifications may be made therein. For example, the adjusting band main body 310 may be separated into two or more portions that overlap one another, and the length of the adjusting band main body 310 may be adjusted by adjusting lengths of overlapping regions.

Referring to FIGS. 8 to 11, the base 350 may be provided apart from the rear adjusting main body 330 by contacting and supporting the rear surface of the head 5 of the wearer. The base 350 may include a TPU material. Therefore, the base 350 may be provided in close contact with the rear surface of the head 5 of the wearer and provide comfort.

The base 350 may be formed in an arch shape, and thus the rear surface of the head 5 of the wearer may be stably contacted and supported thereby.

A through hole 351 may be formed in the center portion of the base 350. As the through hole 351 is formed, sweat from the head 5 of the wearer may be discharged during welding, for example, and ventilation may be expected by allowing the outside air to pass through the through hole 351 to be transmitted to the head 5 of the wearer.

Furthermore, due to the formation of the through hole 351, the rear surface of the head 5 of the wearer is located in a space formed by the base connector 370 between the rear adjusting main body 330 and the base 350, the base 350 may move toward the adjusting band main body 310 even by applying less force to the base 350 having formed therein the through hole 351, and the base connector 370 may stably and elastically support the rear surface of the head 5 of the wearer.

In the base 350 according to an embodiment, holes 10 may be formed around the through hole 351. Therefore, sweat from the head 5 of the wearer may be discharged during welding, for example, and ventilation may be expected by allowing the outside air to pass through the holes 10 to be transmitted to the head 5 of the wearer.

Furthermore, since the base 350 according to an embodiment is formed as a hollow type in which the through hole 351 is formed at the center portion, the head 5 of the wearer may be stably supported in conformity with the shape of the head 5 of the wearer.

The base connector 370 according to an embodiment connects between the rear adjusting main body 330 and the base 350 and may separate the rear adjusting main body 330 and the base 350 from each other. Therefore, a space may be formed between the rear adjusting main body 330 and the base 350.

At least one bent portion 371 may be formed at the base connector 370 according to an embodiment, and the base connector 370 may elastically support the base 350 by including an elastic material.

An inner space of the base connector 370 formed between the rear adjusting main body 330 and the base 350 is formed as a cavity, and the space provides an elastic force when a wearer moves his/her head.

The operation mechanism and the effect of the head band 1 according to an embodiment as described above will be described.

Referring to FIGS. 1 to 12, the head band 1 according to an embodiment may include the band main body 100, the supporting band 200, and the adjusting band 300.

A wearer wears the helmet H to be protected from harmful substances generated during work like welding. The head band 1 according to an embodiment, and more particularly, the band main body 100 may be coupled to the helmet H and worn on the head 5 of the wearer.

Referring to FIGS. 2 and 12, FIG. 12 is a schematic view of a state in which the helmet H is coupled to the head band 1 according to an embodiment, and FIG. 2 is a side view of a state in which the head band 1 is attached to the head 5 of the wearer, wherein the helmet h is omitted.

Referring to FIGS. 2 and 12, the band main body 100 is coupled to the helmet H, the front supporting unit 110 formed toward the front surface of the head 5 (the left side in FIG. 2) closely contacts the front surface of the head 5 of the wearer (that is, the forehead region), the upper portion of the head 5 is contacted and supported by the supporting band 200, and the rear surface of the head 5 (that is, the occipital region) may be contacted and supported by the adjusting band 300.

Referring to FIGS. 1 to 3, the front supporting unit 110 of one or more embodiments may include the front supporting main body 111 and the front adjusting unit 115. Since a plurality of front supporting main bodies 111 are formed, it is possible to contact and support the front surface of the head 5 of the wearer in a relatively large area compared to a case where the single front supporting main body 111 is formed.

In addition, as the plurality of front supporting main bodies 111 contact the front surface of the head 5 of the wearer, the head band 1, and more particularly, the front supporting unit 110 is stably position-fixed to the head 5 of the wearer and may be prevented from being separated from the head 5 of the wearer.

Referring to FIGS. 2, 3, the front supporting wing 113 may protrude from both side end portions (the upper end portion and the lower end portion in FIG. 3) of the front supporting main body 111 in the lengthwise direction of the front supporting main body 111 (the horizontal direction in FIG. 3).

As the front supporting wing 113 is formed to protrude from the front supporting main body 111 at a predetermined angle from the lengthwise direction of the front supporting main body 111 and includes an elastic material, the front supporting unit 110 may be prevented from being lifted from the front surface of the head 5 of the wearer, and more particularly, the forehead of the wearer.

Referring to FIG. 3, as the front adjusting unit 115, and more particularly, the front adjusting main body 116 is connected to the cut portion 112 formed at the center of the front supporting main body 111 and the wearer holds the front adjusting lever 117 coupled to the front adjusting main body 116 and rotates the same clockwise or counterclockwise, the position of the front supporting main body 111 on the front surface of the head 5 of the wearer (that is, the forehead region) may be adjusted according to the shape of the head 5 of the wearer.

Referring to FIGS. 1, 2, 4A, and 5 to 7C, the supporting band 200 according to an embodiment contacts and supports the upper portion of the head 5 and may include the supporting band main body 210 and the contacting portion 230.

The contacting portion 230 may move on the supporting band main body 210 and may disperse weight of the helmet H by contacting and supporting the upper portion of the head 5 of the wearer at two or more points. In other words, weight of the helmet H coupled to the head band 1 may be dispersed to two or more points, thereby reducing fatigue of the wearer and improving wearing convenience.

Referring to FIGS. 6A to 7C, the supporting band main body 210 includes the first region in which the adjusting groove 211 is formed and the second region in which an adjusting groove 211 is not formed, and the length of the supporting band main body 210 may be adjusted by the contacting portion 230.

Referring to FIGS. 6A to 6C, a state in which the length of the supporting band main body 210 is fixed is shown. The lock 233 (more particularly, the locking protrusion 235) formed at the contacting portion 230 (more particularly, the moving main body 231) is accommodated and position-fixed on the adjusting groove 211, and thus the length of the supporting band main body 210 may be fixed.

Referring to FIGS. 7A to 7C, the wearer may press the moving lever 237 connected to the moving plate 232 toward the lock 233 (more particularly, the lock head 236) faced by the moving lever 237, and thus the lock head 236 may move upward (in FIG. 7C) along a groove formed at the moving lever 237.

When the lock head 236 is moved upward, the locking protrusion 235 formed on one surface of the lock main body 234 (the bottom surface in FIG. 7C) is separated from the adjusting groove 211 formed on the supporting band main body 210, and the contacting portion 230, and more particularly, the moving main body 231 may be moved on the supporting band main body 210.

As the moving main body 231 is moved on the supporting band main body 210, the length of a region where the first region having formed therein the adjusting groove 211 and the second region without the adjusting groove 211 overlap is changed, and the length of the supporting band 200 may be adjusted according to the size of the head 5 of the wearer.

Since one surface of the groove formed in the moving lever 237 or one surface of the lock head 236 facing the groove is inclined, when the groove formed in the moving lever 237 contacts the lock head 236, the lock head 236 may stably move in the vertical directions (in FIG. 7C).

Referring to FIGS. 2, 4A, and 5, since the supporting portion 238 according to an embodiment, and more particularly, the supporting main body 239*a* is formed in an arch shape, the shape of the supporting main body 239*a* corresponds to the shape of the head 5 of the wearer, and thus the supporting main body 239*a* may cover the head 5 of the wearer and may be stably mounted thereon.

Referring to FIGS. 1, 2, 8 to 12, the adjusting band 300 according to an embodiment may include the adjusting band main body 310, the rear adjusting main body 330, the base 350, and the base connector 370.

The wearer may adjust the length of the adjusting band main body 310 by operating the rear adjusting main body 330. The rear surface of the head 5 of the wearer, that is, the occipital region is contacted and supported by the base 350, and one surface of the base 350 contacting the head 5 of the wearer includes a soft material like TPU, and thus wearing convenience of the wearer may be improved.

The through hole 351 is formed in the center portion of the base 350, the base connector 370 is provided between the rear adjusting main body 330 and the base 350, and the interior of the base connector 370 having formed thereat the bent portion 371 may be formed as a cavity.

The base connector 370 may include an elastic material. Therefore, when the wearer moves the head, the base connector 370 may cope with the movement of the head as much as the space formed in the base connector 370, and thus wearing convenience may be improved.

Furthermore, due to the through hole 351 formed in the base 350, as compared to the case where the front surface of the base 350 has a plate-like shape without a through hole formed therein, the inner space formed in the base connector 370 may allow elastic deformation when the wearer moves the head.

Referring to FIGS. 9 and 11, due to at least one bent portion 371 formed at the base connector 370 according to an embodiment, a gap between the rear adjusting main body 330 and the base 350 may be elastically deformed as the wearer moves the head 5, and thus the rear surface of the head 5 of the wearer may be stably supported.

Referring to FIGS. 1, 2, and 12, the holes 10 may be formed in the band main body 100, the supporting band 200, and the adjusting band 300. As the holes 10 are formed, sweat from the head 5 of the wearer may be discharged during welding, for example.

Furthermore, ventilation may be expected by allowing the outside air to pass through the holes 10 to be transmitted to the head 5 of the wearer.

The head band 1 according to an embodiment may be applied not only to a helmet having a welding shield, but also to a hard hat, a security shield, a medical product (shield), a helmet for bicycles, a sport helmet, a virtual reality (VR) headset, etc.

In a head band according to one or more embodiments, a contacting portion is connected to a single supporting band main body and contacts and supports the upper portion of a head at two or more points, thereby dispersing the weight of a helmet.

Also, since the supporting main body is formed in an arch shape, the head of a wearer is stably contacted and supported, and wearing convenience is improved.

Also, a contacting portion may be moved and relocated on a supporting band main body, thereby enabling adjustment of the length of the supporting band main body.

Also, a plurality of front supporting main bodies are provided, thereby stably contacting and supporting the front surface of the head of a wearer.

Also, the position of a front supporting main body may be conveniently adjusted due to a front adjusting unit, and a band main body may be prevented from being detached from the head of the wearer.

Also, due to a base connector, a rear adjusting main body and a base are spaced apart from each other to form a space therebetween, and the rear surface of the head of the wearer may be elastically supported.

Also, due to a through hole formed in a base, elastic support for the rear surface of the head of the wearer due to the base connector may be improved.

Also, when the wearer wants to reduce the tightening force of the head band, a contacting portion may be slided on a supporting band main body by pressing a moving lever toward a locking protrusion in a one-touch manner, and thus user convenience may be improved.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A head band comprising:

a band main body coupled to a helmet and comprising a front supporting unit that is configured to contact and support a front surface of a user's head, wherein the front supporting unit comprises:

two front supporting main bodies, which are arranged side by side and apart from one another, and a front adjusting unit configured to connect the two front supporting main bodies, wherein:

a cut portion is formed at each of the two front supporting main bodies to open the center portion thereof, and the front adjusting unit comprises a front adjusting main body which is formed in an 'X' shape and coupled to each of the cut portion of the two front supporting main bodies;

an adjusting band, which is positioned opposite the front supporting unit, is coupled to the band main body, and is configured to contact and support a rear surface of the user's head, and is length-adjustable, and a supporting band rotatably coupled to the band main body, wherein the supporting band is configured to contact and support an upper portion of the user's head and is positioned between the front supporting unit and the adjusting band, wherein the supporting band comprises:

a supporting band main body of which both end portions are coupled to the band main body, and a contacting portion connected to the supporting band main body, the contacting portion is configured to contact and support the upper portion of the user's head at two or more points.

2. The head band of claim 1, wherein a front supporting wing protrudes from side portions of the two front supporting main bodies around a lengthwise direction of the two front supporting main bodies.

3. The head band of claim 1, wherein:

the supporting band main body defines an axis;

the contacting portion comprises a moving main body configured to be movable along the axis of the supporting band main body to adjust a tension of the supporting band.

4. The head band of claim 1, wherein the adjusting band comprises:

an adjusting band main body coupled to the band main body;

a rear adjusting main body coupled to the adjusting band main body and adjusting a length of the adjusting band main body;

a base configured to contact and support a rear surface of a head; and a base connector configured to connect between the rear adjusting main body and the base and separate the rear adjusting main body and the base from each other.

* * * * *